US007096874B2

(12) United States Patent
Forshpan

(10) Patent No.: US 7,096,874 B2
(45) Date of Patent: Aug. 29, 2006

(54) CANOPY FOR CO-SLEEPER, CRIB OR PLAY YARD

(75) Inventor: Sharon Forshpan, Malibu, CA (US)

(73) Assignee: Arms Reach Concepts, Inc., Malibu, CA (US)

( * ) Notice: Subject to any disclaimer, the term of this patent is extended or adjusted under 35 U.S.C. 154(b) by 233 days.

(21) Appl. No.: 10/651,581

(22) Filed: Aug. 28, 2003

(65) Prior Publication Data

US 2005/0045221 A1 Mar. 3, 2005

(51) Int. Cl.
*A47D 15/00* (2006.01)
*A47D 13/06* (2006.01)

(52) U.S. Cl. ..... 135/96; 135/135; 135/117; 5/97

(58) Field of Classification Search ..... 135/87, 135/93, 94, 96, 124, 125, 126, 132, 133, 135/128, 135, 159, 161, 115, 117, 119, 907, 135/913; 5/97, 424, 414, 416, 93.1, 94.6
See application file for complete search history.

(56) References Cited

U.S. PATENT DOCUMENTS

| | | | | | |
|---|---|---|---|---|---|
| 860,379 | A | | 7/1907 | Hodes | |
| 1,134,009 | A | | 3/1915 | Reid | |
| 2,314,830 | A | * | 3/1943 | Hunter | 135/93 |
| 2,948,287 | A | * | 8/1960 | Rupert | 135/126 |
| 2,953,145 | A | * | 9/1960 | Moss et al. | 135/98 |
| 4,043,349 | A | | 8/1977 | Gays et al. | |
| 4,280,521 | A | * | 7/1981 | Zeigler | 135/120.3 |
| 4,790,340 | A | * | 12/1988 | Mahoney | 135/90 |
| 4,966,178 | A | * | 10/1990 | Eichhorn | 135/123 |
| 5,069,572 | A | * | 12/1991 | Niksic | 403/170 |
| 5,339,851 | A | * | 8/1994 | Miller et al. | 135/88.05 |
| 5,517,707 | A | * | 5/1996 | LaMantia | 5/97 |
| D372,953 | S | * | 8/1996 | Florez | D21/838 |
| 5,666,986 | A | | 9/1997 | Fox | |
| 5,673,720 | A | | 10/1997 | Cuthill | |
| 5,930,854 | A | | 8/1999 | O'Neill et al. | |
| 6,123,091 | A | | 9/2000 | Flynn et al. | |
| D444,840 | S | * | 7/2001 | Glover et al. | D21/834 |
| 6,345,639 | B1 | | 2/2002 | Rousselle et al. | |
| 6,516,823 | B1 | | 2/2003 | Glover et al. | |
| 6,550,083 | B1 | | 4/2003 | LaMantia | |
| 6,694,546 | B1 | * | 2/2004 | Kasem | 5/93.1 |

* cited by examiner

*Primary Examiner*—Janet M. Wilkens
(74) *Attorney, Agent, or Firm*—Reed Smith LLP

(57) ABSTRACT

A collapsible, portable canopy is adapted for use with a co-sleeper, crib or play yard. The canopy includes a frame and has at least three canopy support arms pivotally attached to an arm attachment portion. The canopy cover has a central opening at the top that fits over the frame and includes tubular enclosures located on an inner surface of the canopy cover that are open at their upper ends adjacent the opening and fit slidably over the canopy support arms. The central opening has a removable cover. The support arms of the frame are inserted into the tubular members through the central opening. The canopy cover includes an elastic member integral with the surrounding lower edge that urges it and the support arms toward the outer perimeter of a co-sleeper, crib or play yard. The canopy cover is made of mesh material and includes a reclosable opening for interior access.

8 Claims, 5 Drawing Sheets

CANOPY FOR CO-SLEEPER, CRIB OR PLAY YARD

FIELD OF INVENTION

The instant invention relates to canopies or covers for enclosure for infants and young children. In particular the invention is designed to be easily attached to and removed from bedside co-sleepers, cribs and play yards.

BACKGROUND OF THE INVENTION

Enclosure for infants and young children are often used in outdoor environments or in rooms with open doors and windows, particularly in warm weather. Under such circumstances children in such enclosures are often a target for insects and even projectiles thrown by other children. In addition, direct exposure to sunlight can be particularly harmful to infants and young children who are often unable to escape the sun's rays in such enclosures. Various types of canopies and covers for play yards and other enclosures have been developed to deal with these problems.

U.S. Pat. No. 6,516,823, issued to Glover et al. teaches a collapsible play yard canopy for covering the top of a play yard. When not in use, the canopy can easily be collapsed and stored. The canopy includes an umbrella-like structure and a canopy cover that is configured to be opened to gain access into the play yard. A zipper connector is provided to join adjacent flaps in the front of a ceiling panel of canopy cover U.S. Pat. No. 6,550,083, issued to LaMantia discloses a crib and playpen protective covering. The enclosure includes a dome-shaped top with opposed end panels and side panels. The structure of the enclosure may be comprised of a mesh cloth, however, portions may be covered with reinforcing fabric or other materials as necessary. The top of the structure is supported by two semi-rigid ribs to define the dome structure and when removed from the crib may be rolled or compressed for storage. A flap is included in the dome-shaped top in order to provide access to the interior.

U.S. Patent Application Publication No. 2002/0092554 by Ham et al. is directed to a canopy tent with automatic umbrella-type collapsible frame.

U.S. Pat. No. 5,666,986, issued to Fox discloses a tent frame device that includes an umbrella-like structure that may be used as a tent or cover. Fabric sheet material is suspended from the frame and has a zipper defining a door for access to the interior portion of the device.

U.S. Patent Application Publication No. 2003/00152706 by McClenahan et al. teaches an adjustable table cover system similar to a play yard canopy. The cover may be made from any material such as plastic, cotton, or linen and includes a channel region within which may be placed an elastic ribbon to tightly secure the cover around the perimeter of the table.

It is an objective of the present invention to provide a canopy for use with a wide variety of co-sleepers, cribs and play yards. It is a further objective of the invention to provide a canopy that is easily installed on the desired enclosure without need for special fittings or fixtures. It is still a further objective of the present invention that the unit be simple to erect and collapsible for transport and storage. It is yet a further objective that the canopy provide protection for infants and young children from sunburn and insects. Finally, it is an objective of the invention that the canopy design consider and address all possible safety considerations related to its use. Other features and advantages of the invention will be seen from the following description and drawings. The present invention addresses many of the deficiencies of prior art canopy and enclosure inventions and satisfies all of the objectives described above.

SUMMARY OF THE INVENTION (1) A canopy for a co-sleeper, crib or play yard having a frame that is sized and shaped to extend over a perimeter of a co-sleeper, crib or play yard is provided. The frame has at least three canopy support arms and an arm attachment portion. Each of the canopy support arms have a first end, a second end and are attached at the first end to the arm attachment portion.

A canopy cover is provided. The canopy cover has an inner surface and an outer surface and is sized and shaped to fit over the frame. The canopy cover has a top and a surrounding lower edge and is formed of flexible material An elastic member is provided. The elastic member urges the canopy support arms and surrounding lower edge of the canopy cover toward the perimeter.

(2) In a variant of the invention, the canopy support arms are formed of resilient material.

(3) In a further variant of the invention, the arm attachment portion contains pivotal attachments for each of the canopy support arms.

(4) In yet a further variant of the invention, the pivotal attachments for each of the canopy support arms limit upward travel of each of the support arms to a plane parallel to an upper surface of the arm attachment portion.

(5) In still a further variant, means are provided for securing the support arms in the plane parallel to the upper surface of the arm attachment portion.

(6) In still another variant, the means for securing the support arms in the plane parallel to the upper surface of the arm attachment portion includes at least three channels. Each of the channels has a base, a pair of downward extending sides and means for pivotally attaching the first end of the support arm. The channels are sized and shaped to fit slidably about the first end of the support arms.

Each of the channels is mounted to a lower surface of the arm attachment portion. A cover piece is provided. The cover piece has at least three slots. The slots are sized and shaped to fit slidably about the first end of the support arm and are aligned to permit rotation of the support arms. The cover piece is rotatably mounted to the lower surface of the arm attachment portion, and has means attached to a lower surface of the cover piece to assist manual rotation of the cover piece. When the cover piece is rotated to align the slots with the channels, the support arms are pivotable with respect to the arm attachment portion. When the cover piece is rotated to cover the channels, the support arms will be secured in the plane parallel to the upper surface of the arm attachment portion.

(7) In yet another variant the means for securing the support arms in the plane parallel to the upper surface of the arm attachment portion includes at least three channels. Each of the channels has a base, a pair of downward extending sides, means for pivotally attaching the first end of the support arm. The channels are sized and shaped to fit slidably about the first end of the support arms. Each of the channels is mounted to a lower surface of the arm attachment portion. A cover piece is provided. The cover piece has at least three slots. The slots are sized and shaped to fit slidably about the first end of the support arm and aligned to permit rotation of the support arms. The cover piece is rotatably mounted to the lower surface of the arm attachment portion, and has means attached to an upper surface of the cover piece to assist manual rotation of the cover piece. Each of the means extends upwardly through arcurate slots in the arm attachment portion. When the cover piece is rotated to align the slots with the channels, the support arms are pivotable with respect to the arm attachment portion and when the cover piece is rotated to cover the channels, the support arms will be secured in the plane parallel to the upper surface of the arm attachment portion.

(8) In still another variant, each of the means extending upwardly through arcurate slots in the arm attachment portion terminates in a knob for ease of turning.

(9) In still a further variant of the invention, the canopy cover is formed of mesh material.

(10) In another variant, the canopy cover has a reclosable opening that permits access to an interior of the co-sleeper, crib or play yard.

(11) In yet another variant, the canopy cover has at least one hanger attached to the inner surface for suspending items within the canopy cover.

(12) In still a further variant, the canopy cover has a central opening in the top. The opening is sized and shaped to permit access to the arm attachment portion of the frame.

(13) In another variant of the invention, the canopy cover has a reclosable cover for the central opening.

(14) In yet another variant of the invention, the canopy cover has at least one tubular enclosure. The tubular enclosure is located upon the inner surface of the canopy cover. The enclosure has a first end spaced outwardly from the central opening in the top and a second end spaced from the first end, and is sized and shaped to fit slidably over one of the canopy support arms. The tubular enclosure also has an opening at the first end for introduction of one of the canopy support arms.

(15) In a further variant of the invention, the tubular enclosure has a closed second end.

(16) In yet a further variant of the invention, the closed second end of the tubular enclosure is adjacent to the surrounding lower edge of the canopy cover.

(17) In another variant, the elastic member is integral with the surrounding lower edge of the canopy cover.

(18) In yet another variant, the elastic member is located between at least two points that are located upon the inner surface of the canopy cover. The points are spaced downwardly from the top.

(19) In a final variant, the inner surface of the canopy cover that has frictional elements disposed adjacent the surrounding lower edge for securing the canopy to the perimeter.

Figure 1:
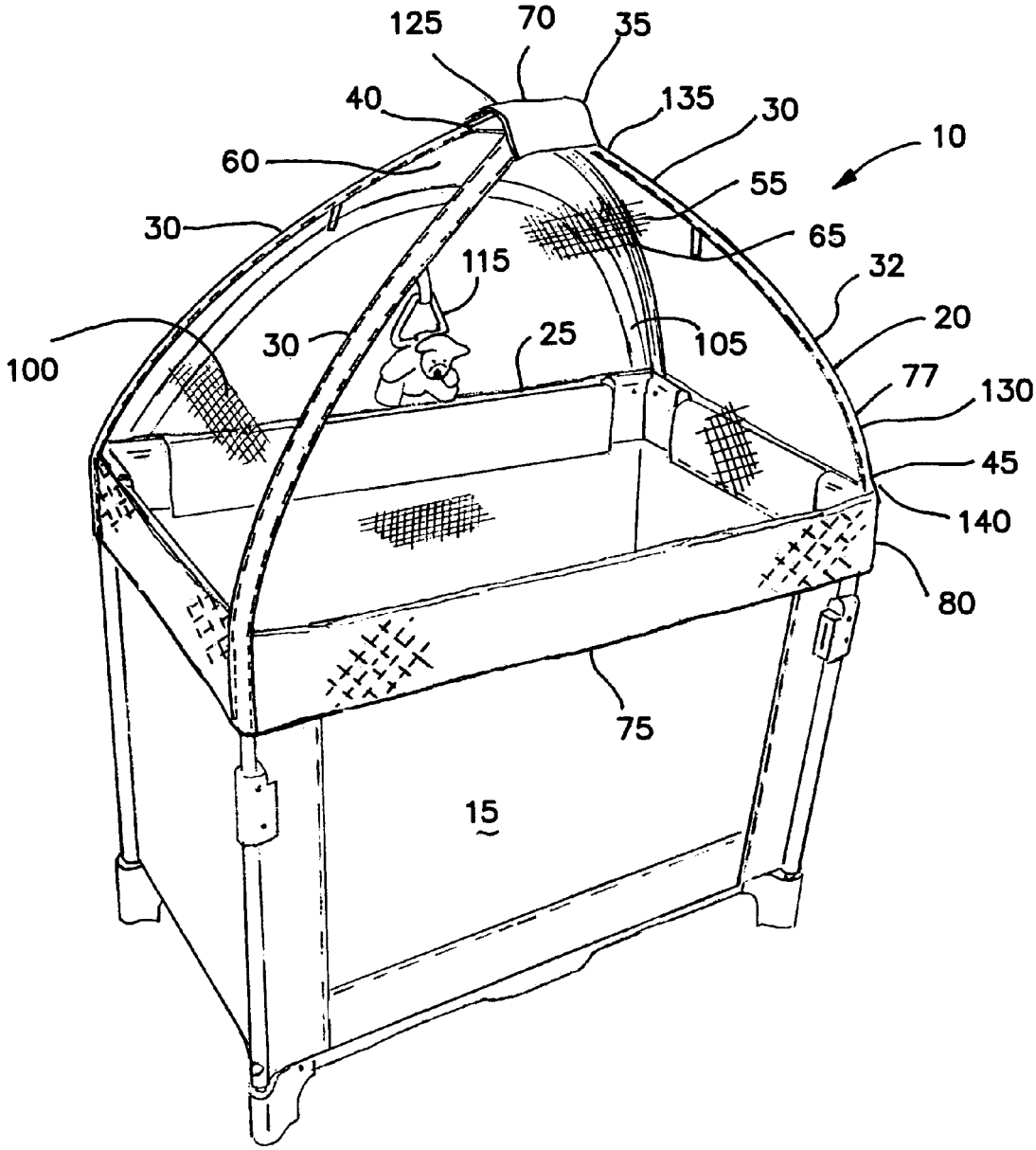
FIG. 1 is a perspective view of a first embodiment of a canopy for a co-sleeper, crib or play yard attached to a co-sleeper.

DETAILED DESCRIPTION (1) As illustrated in FIGS. 1–6, a canopy 10 for a co-sleeper 15, crib (not shown) or play yard (not shown) having a frame 20 that is sized and shaped to extend over a perimeter 25 of a co-sleeper 15, crib or play yard is provided. The frame 20 has at least three canopy support arms 30 and an arm attachment portion 35. Each of the canopy support arms 30 have a first end 40, a second end 45 and are attached at the first end 40 to the arm attachment portion 35.

A canopy cover 55 is provided. The canopy cover 55 has an inner surface 60 and an outer surface 65 and is sized and shaped to fit over the frame 20. The canopy cover 55 has a top 70 and a surrounding lower edge 75 and is formed of flexible material 77.

An elastic member 80 is provided. The elastic member 80 urges the canopy support arms 30 and surrounding lower edge 75 of the canopy cover 55 toward the perimeter 25.

Figure 4:
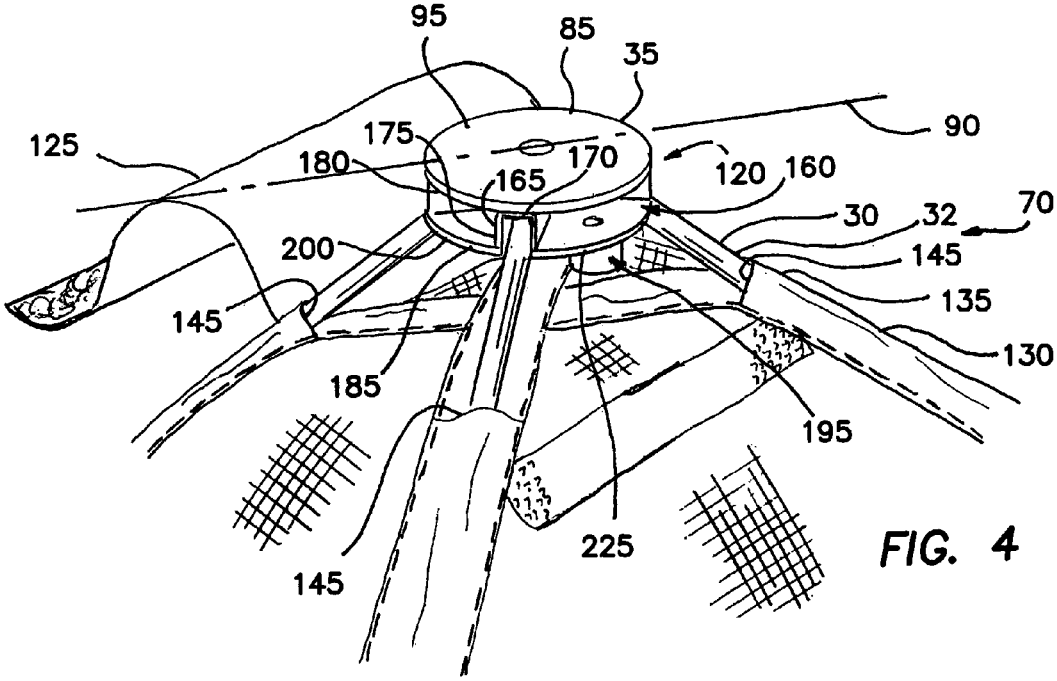
FIG. 4 is a detailed perspective view illustrating an outer surface of the canopy cover, the frame, the arm attachment portion, the tubular enclosures and a central opening.

(2) In a variant of the invention, as shown in FIGS. 1 and 4, the canopy support arms 30 are formed of a resilient material 32.

(3) In a further variant of the invention, as shown in FIG. 4, the arm attachment portion 35 contains pivotal attachments 85 for each of the canopy support arms 30.

(4) In yet a further variant of the invention, also shown in FIG. 4, the pivotal attachments 85 for each of the canopy support arms 30 limit upward travel of each of the support arms 30 to a plane 90 parallel to an upper surface 95 of the arm attachment portion 35.

(5) In still a further variant, as shown in FIG. 4, means 160 are provided for securing the support arms 30 in the plane 90 parallel to the upper surface 95 of the arm attachment portion 35.

(6) In still another variant, as shown in FIG. 4, the means 160 for securing the support arms 30 in the plane 90 parallel to the upper surface 95 of the arm attachment portion 35 includes at least three channels 165. Each of the channels 165 has a base 170, a pair of downward extending sides 175 and means (not shown) for pivotally attaching the first end 40 of the support arm 30. The channels 165 are sized and shaped to fit slidably about the first end 40 of the support arms 30.

Each of the channels 165 is mounted to a lower surface 180 of the arm attachment portion 35. A cover piece 185 is provided. The cover piece 185 has at least three slots 190. The slots 190 are sized and shaped to fit slidably about the first end 40 of the support arm 30 and are aligned to permit rotation of the support arms 30. The cover piece 185 is rotatably mounted to the lower surface 225 of the arm attachment portion 35, and has means 195 attached to a lower surface 200 of the cover piece 185 to assist manual rotation of the cover piece 185. When the cover piece 185 is rotated to align the slots 190 with the channels 165, the support arms 30 are pivotable with respect to the arm attachment portion 35. When the cover piece 185 is rotated to cover the channels 165, the support arms 30 will be secured in the plane 90 parallel to the upper surface 225 of the arm attachment portion 35.

Figure 6:
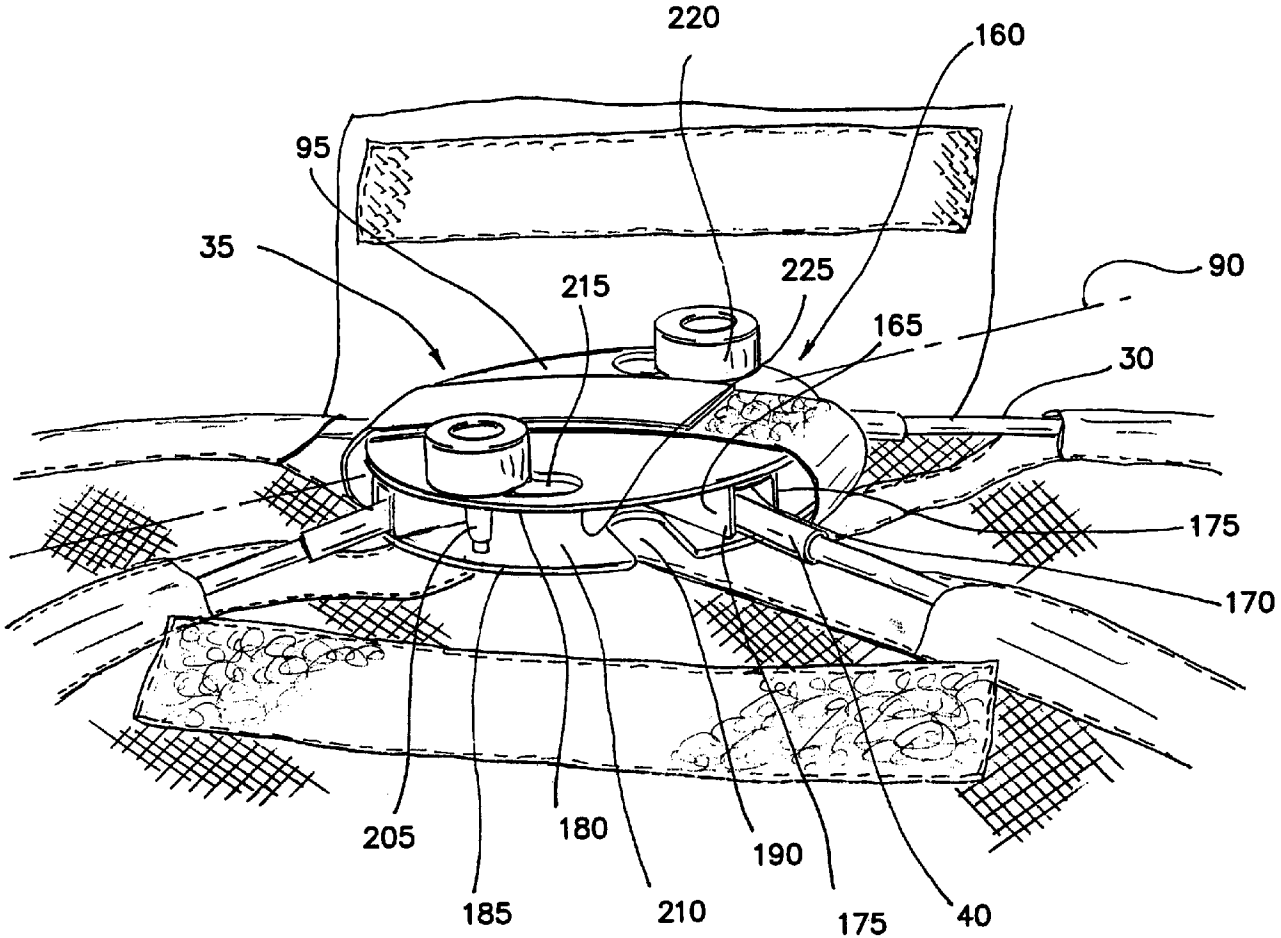
FIG. 6 is a perspective view of an alternative design for a means for securing the support arms in the plane parallel to the upper surface of the arm attachment portion.

(7) In still another variant, as shown in FIG. 6, the means 160 for securing the support arms 30 in the plane 90 parallel to the upper surface 95 of the arm attachment portion 35 includes at least three channels 165. Each of the channels 165 has a base 170, a pair of downward extending sides 175 and means (not shown) for pivotally attaching the first end 40 of the support arm 30. The channels 165 are sized and shaped to fit slidably about the first end 40 of the support arms 30.

Each of the channels 165 is mounted to a lower surface 180 of the arm attachment portion 35. A cover piece 185 is provided. The cover piece 185 has at least three slots 190. The slots 190 are sized and shaped to fit slidably about the first end 40 of the support arm 30 and are aligned to permit rotation of the support arms 30. The cover piece 185 is rotatably mounted to the lower surface 225 of the arm attachment portion 35, and has means 205 attached to an upper surface 210 of the cover piece 185 to assist manual rotation of the cover piece 185. Each of the means 205 extends upwardly through arcurate slots 215 in the arm attachment portion 35. When the cover piece 185 is rotated to align the slots 190 with the channels 165, the support arms 30 are pivotable with respect to the arm attachment portion 35. When the cover piece 185 is rotated to cover the channels 165, the support arms 30 will be secured in the plane 90 parallel to the upper surface 95 of the arm attachment portion 35.

(8) In still another variant, each of the means 205 extending upwardly through arcurate slots 215 in the arm attachment portion 35 terminates in a knob 220 for ease of turning.

(9) In still a further variant of the invention, as shown in FIGS. 1, 2, 3, 4 and 5, the canopy cover 55 is formed of a mesh material 100.

Figure 2:
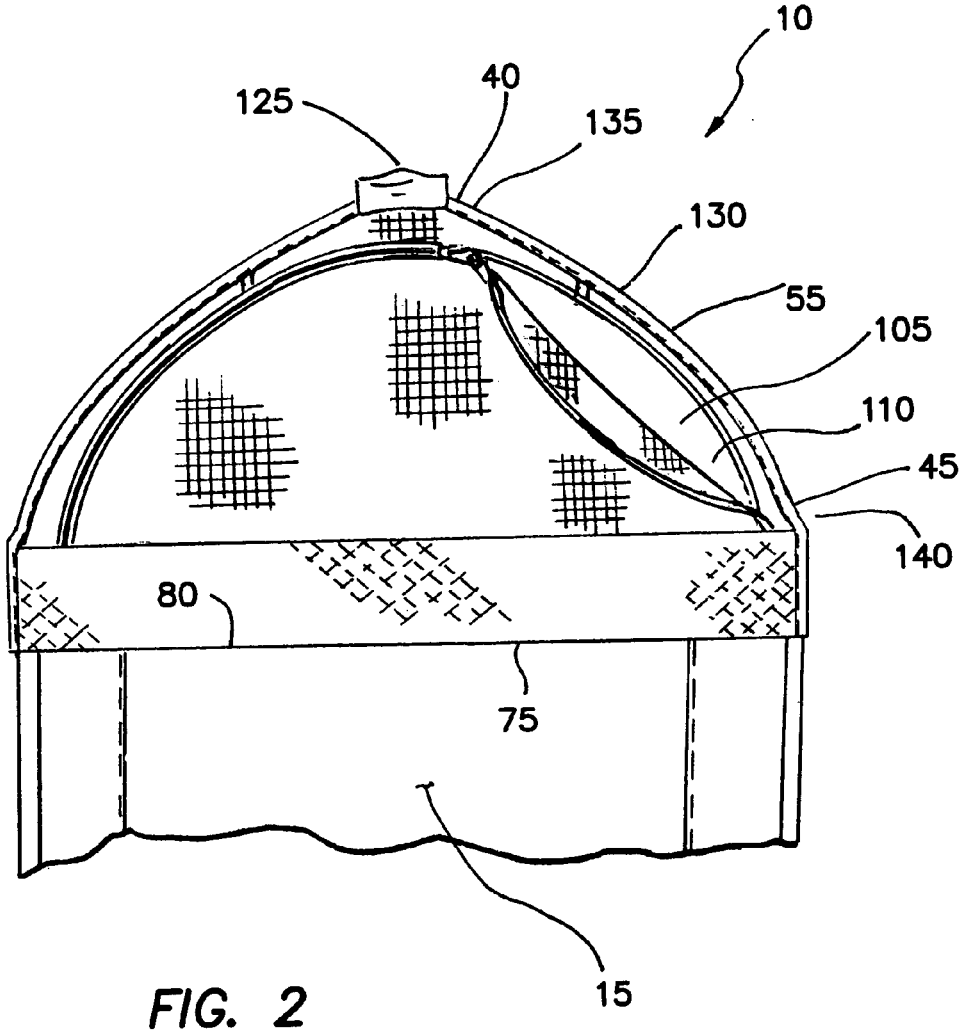
FIG. 2 is a detailed side elevational view of the canopy illustrating a frame, a canopy cover and a reclosable opening.
Figure 5:
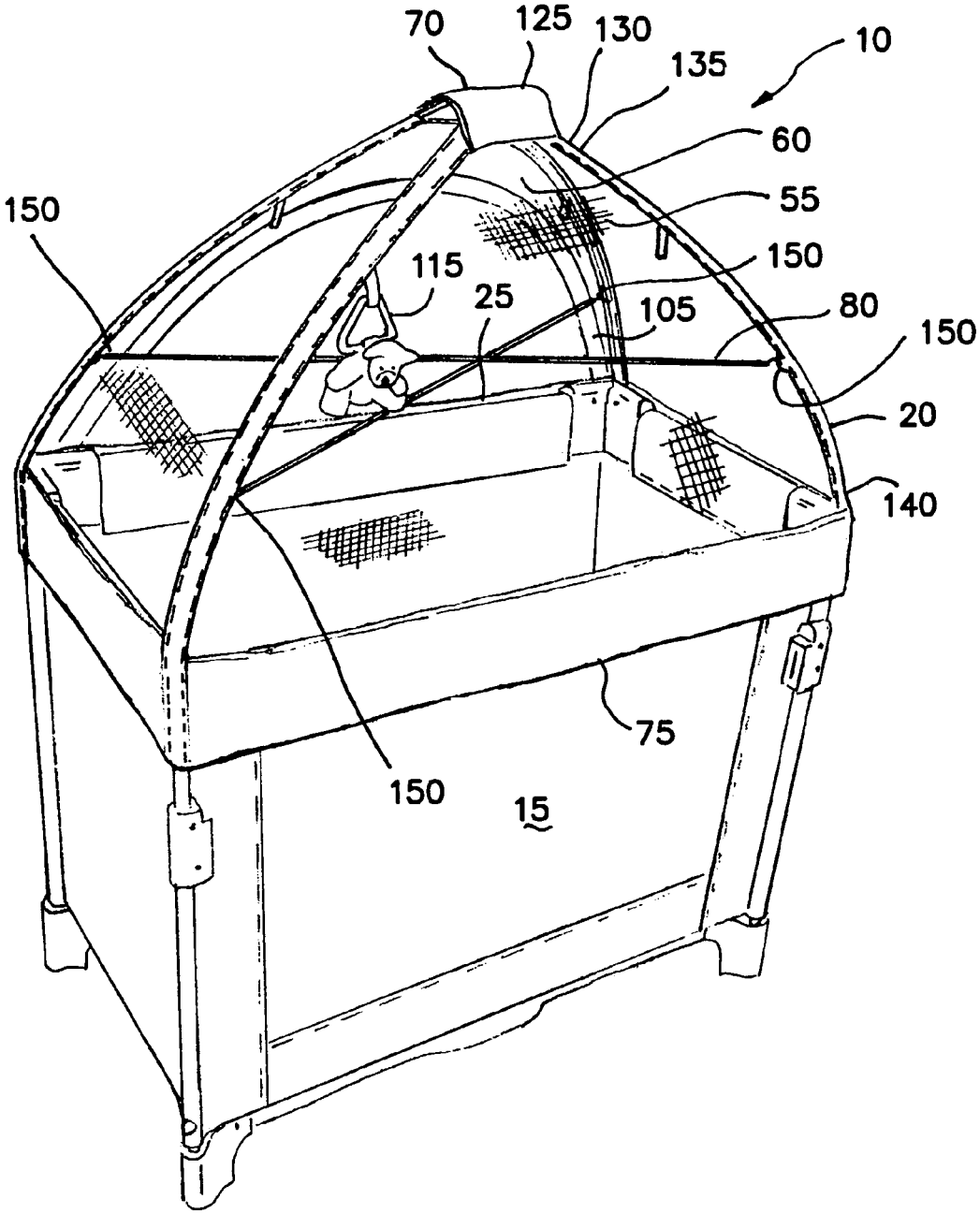
FIG. 5 is a perspective view of the canopy for a co-sleeper, crib or play yard attached to co-sleeper illustrating the elastic member located upon the inner surface of the canopy cover.

(10) In another variant, as shown in FIGS. 1, 2 and 5, the canopy cover 55 has a reclosable opening 105 that permits access to an interior 110 of the co-sleeper 15, crib or play yard.

(11) In yet another variant, as shown in FIGS. 1 and 5, the canopy cover 55 has at least one hanger 115 attached to the inner surface 60 for suspending items within the canopy cover 55.

Figure 3:
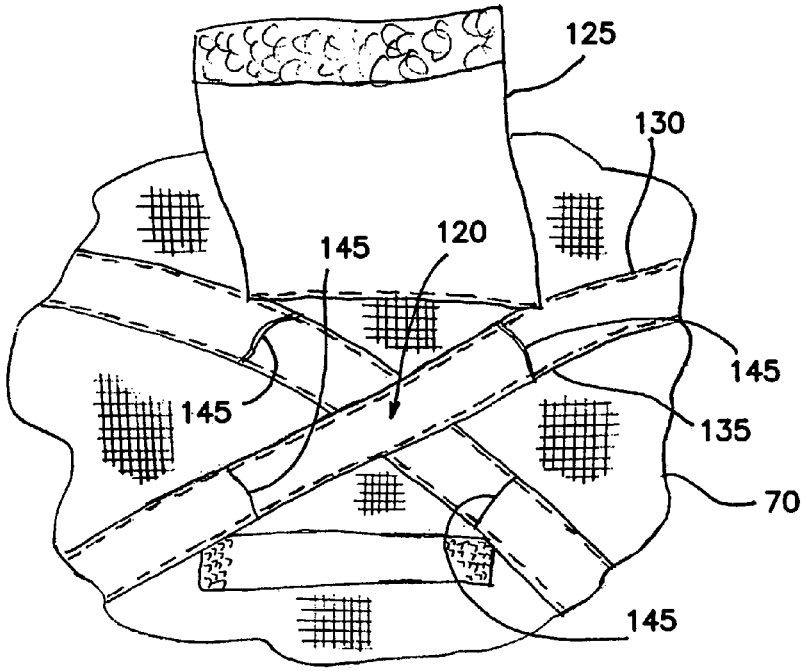
FIG. 3 is a detailed plan view of the outer surface of the of the canopy cover, illustrating tubular enclosures and a central opening.

(12) In still a further variant, as shown in FIGS. 3 and 4, the canopy cover 55 has a central opening 120 in the top 70. The opening 120 is sized and shaped to permit access to the arm attachment portion 35 of the frame 20.

(13) In another variant of the invention, as shown in FIGS. 1, 2, 3, 4 and 5 the canopy cover 55 has a reclosable cover 125 for the central opening 120.

(14) In yet another variant of the invention, as shown in FIGS. 1, 2, 3, 4 and 5 the canopy cover 55 has at least one tubular enclosure 130. The tubular enclosure 130 is located upon the inner surface 60 of the canopy cover 55. The tubular enclosure 130 has a first end 135 spaced outwardly from the central opening 120 in the top 70 and a second end 140 spaced from the first end 135, and is sized and shaped to fit slidably over one of the canopy support arms 30. The tubular enclosure 130 also has an opening 145 at the first end 135 for introduction of one of the canopy support arms 30.

(15) In a further variant of the invention, as shown in FIGS. 1, 2 and 5, the tubular enclosure 130 has a closed second end 140.

(16) In yet a further variant of the invention, shown in FIGS. 1, 2 and 5, the closed second end 140 of the tubular enclosure 130 is adjacent to the surrounding lower edge 75 of the canopy cover 55.

(17) In another variant, as shown in FIGS. 1 and 2, the elastic member 80 is integral with the surrounding lower edge 75 of the canopy cover 55.

(18) In yet another variant, as shown in FIG. 5, the elastic member 80 is located between at least two points 150 that are located upon the inner surface 60 of the canopy cover 55. The points 150 are spaced downwardly from the top 70.

(19) In a final variant, as shown in FIGS. 1 and 2, the inner surface 60 of the canopy cover 55 that has frictional elements (not shown) located adjacent the surrounding lower edge 75 for securing the canopy 10 to the perimeter 25.

The canopy 10 for a co-sleeper, crib or play yard has been described with reference to particular embodiments. Other modifications and enhancements can be made without departing from the spirit and scope of the claims that follow.

The invention claimed is:

1. A canopy for a co-sleeper, crib or play yard comprising:

a frame, said frame being sized and shaped to extend over a perimeter of a co-sleeper, crib or play yard;

said frame comprising at least three canopy support arms and an arm attachment portion;

each of said canopy support arms having a first end and a second end and being attached at said first end to said arm attachment portion;

a canopy cover, said canopy cover having an inner surface and an outer surface and being sized and shaped to fit over said frame;

said canopy cover being formed of flexible material and having a top and a surrounding lower edge;

an elastic member, said elastic member urging said canopy support arms and said surrounding lower edge of said canopy cover toward said perimeter;

wherein said arm attachment portion comprises pivotal attachments for each of said canopy support arms; and wherein said pivotal attachments for each of said canopy support arms limit upward travel of each of said support arms to a plane parallel to an upper surface of said arm attachment portion.

2. The canopy for a co-sleeper, crib or play yard, as described in claim 1, further comprising means for securing said support arms in said plane parallel to said upper surface of said arm attachment portion.

3. The canopy for a co-sleeper, crib or play yard, as described in claim 2, wherein said means for securing said support arms in said plane parallel to said upper surface of said arm attachment portion further comprises:

at least three channels, each of said channels having a base, a pair of downward extending sides, means for pivotally attaching said first end of said support arm and being sized and shaped to fit slidably about said first end of said support arm, each of said channels being mounted to a lower surface of said arm attachment portion; a cover piece, said cover piece having at least three slots, said slots being sized and shaped to fit slidably about said first end of said support arm and aligned to permit rotation of said support arms;

said cover piece being rotatably mounted to said lower surface of said arm attachment portion, and having means attached to a lower surface of said cover piece to assist manual rotation of said cover piece;

whereby, when said cover piece is rotated to align said slots with said channels, said support arms are pivotable with respect to said arm attachment portion and when said cover piece is rotated to cover said channels, said support arms will be secured in said plane parallel to said upper surface of said arm attachment portion.

4. The canopy for a co-sleeper, crib or play yard, as described in claim 2, wherein said means for securing said support arms in said plane parallel to said upper surface of said arm attachment portion further comprises:

at least three channels, each of said channels having a base, a pair of downward extending sides, means for pivotally attaching said first end of said support arm and being sized and shaped to fit slidably about said first end of said support arm, each of said channels being mounted to a lower surface of said arm attachment portion;

a cover piece, said cover piece having at least three slots, said slots being sized and shaped to fit slidably about said first end of said support arm and aligned to permit rotation of said support arms;

said cover piece being rotatably mounted to said lower surface of said arm attachment portion, and having means attached to an upper surface of said cover piece to assist manual rotation of said cover piece;

each of said means extending upwardly through arcurate slots in said arm attachment portion;

whereby, when said cover piece is rotated to align said slots with said channels, said support arms are pivotable with respect to said arm attachment portion and when said cover piece is rotated to cover said channels, said support arms will be secured in said plane parallel to said upper surface of said arm attachment portion.

5. The canopy for a co-sleeper, crib or play yard, as described in claim 4, wherein each of said means extending upwardly through arcurate slots in said arm attachment portion terminates in a knob for ease of turning.

6. A canopy for a co-sleeper, crib or play yard comprising:

a frame, said frame being sized and shaped to extend over a perimeter of a co-sleeper, crib or play yard;

said frame comprising at least three canopy support arms and an arm attachment portion;

each of said canopy support arms having a first end and a second end and being attached at said first end to said arm attachment portion;

a canopy cover, said canopy cover having an inner surface and an outer surface and being sized and shaped to fit over said frame;

said canopy cover being formed of flexible material and having a top and a surrounding lower edge;

an elastic member, said elastic member urging said canopy support arms and said surrounding lower edge of said canopy cover toward said perimeter;

wherein said canopy cover comprises a central opening in said top, said opening being sized and shaped to permit access to said arm attachment portion of said frame;

wherein said canopy cover further comprises:

at least one tubular enclosure, said tubular enclosure being disposed upon said inner surface of said canopy cover, having a first end spaced outwardly from said central opening in said top and a second end spaced from said first end, and being sized and shaped to fit slidably over one of said canopy support arms; and said tubular enclosure having an opening at said first end for introduction of one of said canopy support arms;

wherein said tubular enclosure further comprises a closed second end.

7. The canopy for a co-sleeper, crib or play yard, as described in claim 6, wherein said closed second end of said tubular enclosure is adjacent said surrounding lower edge of said canopy cover.

8. A canopy for a co-sleeper, crib or play yard comprising:

a frame, said frame being sized and shaped to extend over a perimeter of a co-sleeper, crib or play yard;

said frame comprising at least three canopy support arms and an arm attachment portion;

each of said canopy support arms having a first end and a second end and being attached at said first end to said arm attachment portion;

a canopy cover, said canopy cover having an inner surface and an outer surface and being sized and shaped to fit over said frame;

said canopy cover being formed of flexible material and having a top and a surrounding lower edge;

an elastic member, said elastic member urging said canopy support arms and said surrounding lower edge of said canopy cover toward said perimeter; and wherein said inner surface of said canopy cover comprises frictional elements disposed adjacent said surrounding lower edge for securing said canopy to said perimeter.

* * * * *